United States Patent [19]

Büttiker et al.

[11] Patent Number: 4,899,897

[45] Date of Patent: Feb. 13, 1990

[54] TAMPER-PROOF CONTAINER CLOSURE

[75] Inventors: Jean-Pierre Büttiker, Witterswil; Max Klaiber, Liestal, both of Switzerland

[73] Assignee: Hoffmann-La Roche Inc., Nutley, N.J.

[21] Appl. No.: 389,247

[22] Filed: Aug. 3, 1989

Related U.S. Application Data

[63] Continuation of Ser. No. 186,680, Apr. 21, 1988, abandoned, which is a continuation of Ser. No. 82,757, Aug. 6, 1987, abandoned, which is a continuation of Ser. No. 866,850, May 23, 1986, abandoned.

[30] Foreign Application Priority Data

May 24, 1985 [CH] Switzerland ..... 2216/85

[51] Int. Cl.[4] ..... B65D 41/32

[52] U.S. Cl. ..... 215/228; 215/231; 215/256; 215/364

[58] Field of Search ..... 215/228, 231, 253, 254, 215/256, 258, 355, 364; 220/214

[56] References Cited

U.S. PATENT DOCUMENTS

| | | | |
|---|---|---|---|
| 2,829,400 | 4/1958 | Morin | 264/46.9 |
| 3,441,161 | 4/1969 | Van Baarn | 215/256 |
| 3,653,529 | 4/1972 | Segmuller | 215/256 |
| 4,476,993 | 10/1984 | Krout | 215/256 |
| 4,519,514 | 5/1985 | Agbay et al. . | |
| 4,546,892 | 10/1985 | Couput | 215/223 |
| 4,607,759 | 8/1986 | Boetzkes . | |
| 4,646,926 | 3/1987 | Agbay et al. . | |

FOREIGN PATENT DOCUMENTS

| | | | |
|---|---|---|---|
| 117104 | 2/1984 | European Pat. Off. . | |
| 1218489 | 5/1960 | France | 215/231 |
| 1564000 | 4/1969 | France . | |
| 2040941 | 1/1971 | France . | |
| 2134286 | 8/1972 | France . | |
| 1423834 | 5/1972 | United Kingdom . | |

*Primary Examiner*—Stephen Marcus
*Assistant Examiner*—Nova Stucker
*Attorney, Agent, or Firm*—George M. Gould; Bernard S. Leon; A. Kate Huffman

[57] ABSTRACT

A container closure in the form of a stopper is provided in which an outer wall engages exteriorly of the wall of the container. A tamper-proof ring is secured to the underside thereof by means of tear-off webs. The internal cylindrical surface of the ring comprises tabs directed obliquely inwardly and in the direction of the opening.

8 Claims, 1 Drawing Sheet

TAMPER-PROOF CONTAINER CLOSURE

This application is a continuation of application Ser. No. 07/186,680 filed 4/21/88 which is a continuation of SN 8 2,757 filed 8/6/1987 which is a continuation of Ser. No. 866,850 filed 5/23/1986 now abandoned.

BACKGROUND OF THE INVENTION

1. Field of the Invention

The invention relates to a tamper-proof container closure having a tamper-proof ring. When closed on the container, the tamper-proof ring engages the exterior surface of the wall of the container and is torn away from the rest of the closure the first time the closure is opened.

2. Description of the Prior Art

Various types of closures are known. One of the most frequently used types is the screw cap closure in which a tamper-resistant ring is retained by the lower edge of the threaded portion of the container upon opening.

Another type of closure is the closure plug which is used, for example, on tubes holding effervescent vitamin tablets. In this type of closure, the tamper-proof ring is retained by the lip or flange of the tube. The inside of the ring is provided with a head which, by means of different oblique surfaces, allows the plug with the ring to be fitted on the tube but the ring is retained on the tube upon opening. However, because of the elasticity of the plastic, such a closure cannot be made absolutely safe. It is possible, when opening the closure, to slip the ring over the edge of the tube without using any tool and without tearing the ring away from the plug.

SUMMARY OF THE INVENTION

The basic idea underlying the design of tamper-proof closures is to provide an easily recognizable visual indicator that the closure has been opened. This ensures the originality of the contained matter thereby thwarting efforts at tampering. However, to be effective, a tamper-proof closure must not be easily circumvented.

It is therefore an object of the present invention to provide a tamper-proof closure which cannot easily be removed from the container without tearing away the tamper-proof ring.

According to the present invention, this object is achieved by providing the internal cylindrical surface of the tamper-proof ring with tabs directed obliquely inwardly and in the direction of opening, said tabs engaging under the edge-bead or flange of the wall of the container.

DETAILED DESCRIPTION OF THE INVENTION

Figure 1:
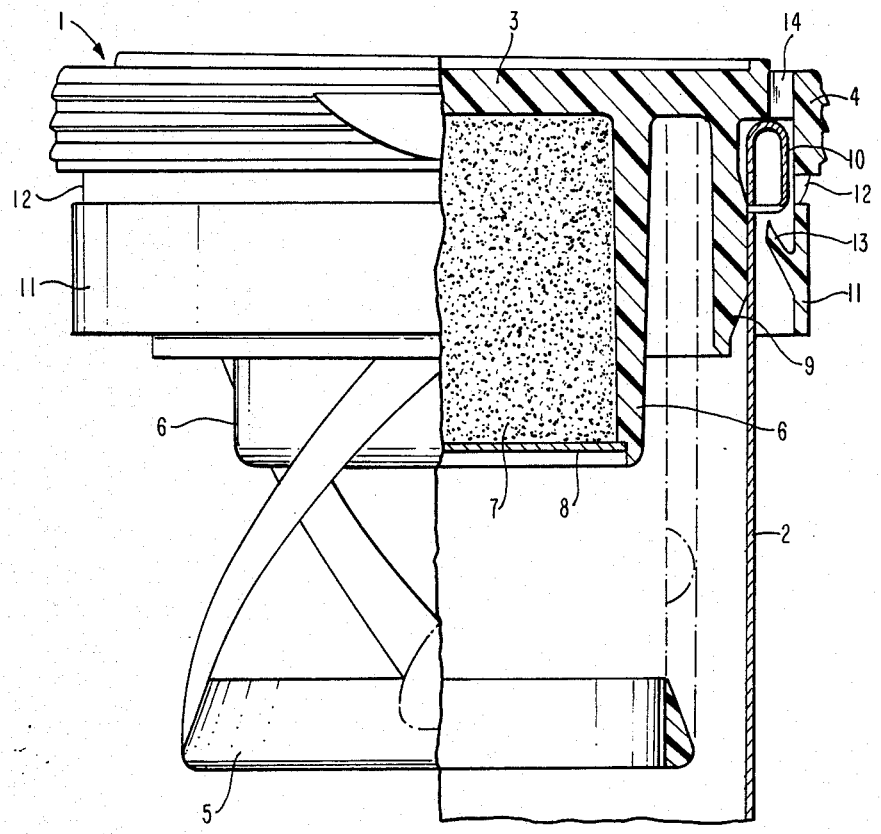
FIG. 1 is a side elevational view partly in crosssection of one embodiment of the tamper-proof closure of the present invention.
Figure 2:
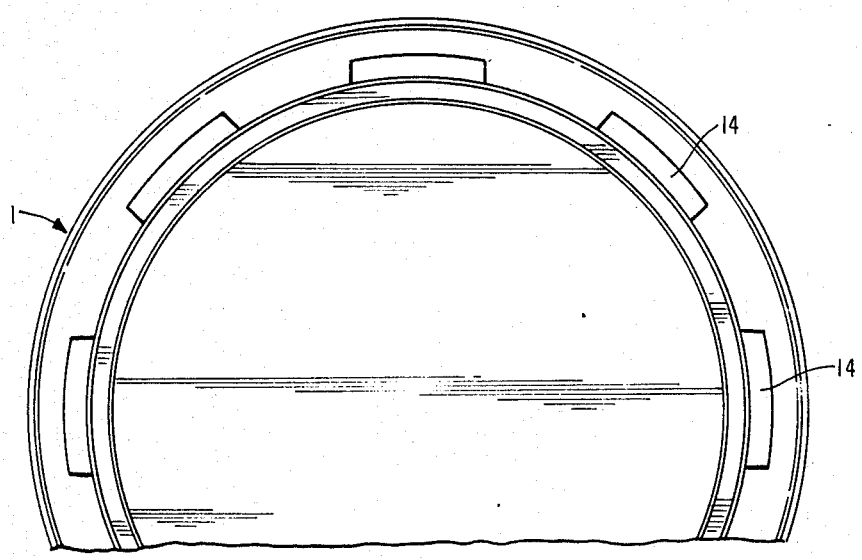
FIG. 2 is a fragmentary top plan view of the closure shown in FIG. 1.

FIGS. 1 and 2 show a stopper 1 for closing an effervescent vitamin tablet tube.

The stopper 1 has a flat cover part 3 and an outer cylindrical wall 4 which engages over the edge of the tube 2. Peripheral ribs 15 are provided on the cylindrical outer surface 16 of wall 4, to make the stopper 1 easier to grip when it is being opened.

The stopper 1 is provided in known fashion with a resiliently fitted ring 5 which holds down the contents of the tube. The stopper 1 also comprises a chamber 6 which is filled with a drying agent 7, closed off by means of a cover 8. Suitable drying agents are well known in the art.

It will be understood that chamber 6, drying agent 7 and cover 8 may be omitted, if desired.

A cylindrical skirt 9, the outside diameter of which corresponds to the inside diameter of tube 2, serves to seal the tube from air and moisture.

As shown in FIG. 1, tube 2 is made of metal, and has a flange 10 provided at its upper edge. In the case of a plastic tube, a peripheral enlargement of the edge would be used instead of the flange.

Outer wall 4 engages over flange 10 to help secure the stopper 1 to the tube 2.

A tamper-proof ring 11 depends from the wall 4 of the stopper 1. The ring 11 is preferably cylindrical and the connection to wall 4 is preferably accomplished by means of thin webs 12 which require only a small amount of force to tear.

However, it will be understood that other tearing means besides webs 12 may be used to breakably connect ring 11 to wall 4, so long as said tearing means would break without applying undue force when said stopper 1 is opened for the first time.

Thus, as illustrated in FIG. 1, the cylindrical skirt 9 provides the principle holding means of securing the stopper 1 in the tube 2. The outer wall 4 of the cover 3 engages over the flange 10 to assist in holding the stopper 1 in place in the tube 2. Without the skirt 9, however, the stopper 1 would not be secured in the tube 2.

There are no other holding elements on the exterior of the tube 2 to hold the stopper 1 in the tube 2 as shown in FIG. 1. The main function of the elements which engage the outer wall of the tube 2, namely, the flange 10, outer wall 4 of the cover 3, tabs 13 and webs 12, is to hold the tamper-proof ring 11 on the tube 2.

When the stopper 1 is removed for the first time and with only a small amount of force, the tabs 13 engage, for the first time, under the flange 10 causing the webs 12 to tear away from the outer wall 4. The tamper-proof ring 11 is thus retained on the tube 2 and the stopper 1 is removed from the container by disengaging the skirt 9 from the inner diameter of the tube 2. The tabs 13 serve as holding elements only when the stopper 1 is removed from the tube 2 for the first time.

Eight tabs 13 are mounted to the inside surface of ring 11. The tabs 13 extend obliquely inwardly and radially in the direction of opening. The tabs 13 engage under flanged edge 10 of tube 2, and are distributed equidistantly around the periphery thereof. Preferably each tab 13 has a segment width of about 20 angular degrees. Instead of the eight tabs provided in the present example, the desired function may still be obtained by a larger or smaller number of tabs 13. Like the stopper 1, the tabs 13 are made of plastic and are correspondingly resilient.

It will be understood that other resilient materials of construction besides plastic may be employed in the present invention, if desired.

When the stopper 1 is opened, tabs 13 act as barbed hooks and engage under flange 10 of the tube 2. Ring 11 is thus firmly held and webs 12 are torn away when the stopper 1 is removed.

Tabs 13 may be produced by conventional means, preferably by molding (e.g., by injection molding). The corresponding molding tool part (not shown) which engages behind each tab 13 must be inserted from above. Therefore, the cover 3 has the same number of recesses 14 as tabs 13 and the segment width of the recesses 14 must be the same as the corresponding width of the tabs 13.

Based upon the foregoing, it will be appreciated that the closure of the present invention can be easily fitted on the container because the resiliency of the tabs 13, permits them to bend during installation. However, once in place, the tabs B take their original shape, as shown in FIG. 1, whereby the tabs 13 will engage the flange 10 of the tube if the stopper 1 is opened. The tamper-proof ring 11 will thus, be retained on the container thereby breaking the webs 12 and providing a visual indication of possible tampering.

It will also be appreciated that the closure of the present invention is extremely difficult to remove intact once it has been installed on the container thereby thwarting attempts to circumvent the closure and tamper with the contents of the container.

We claim:

1. A container and stopper, comprising:

a. a container having an upper edge which defines an opening, and flange means formed at the upper edge of the container around the opening; and b. a stopper having a cover plug, a tamper-proof ring, and attachment means for attaching the tamper-proof ring having an inner surface and tabs attached to said inner surface, said tabs being formed from a resilient material and being directed obliquely inwardly and in the direction of opening but not engaging said flange means for retaining the tamper-proof ring on the container when the cover plug is removed for the first time and the attachment means connecting the cover plug and the tamper-proof ring is broken.

2. The container and stopper according to claim 1, wherein the container has a wall having an exterior surface, and the cover plug comprises a stopper portion having an outer wall which engages the exterior surface of the wall of the container, and wherein the attachment means comprises a plurality of tear-off webs for securing the tamper-proof ring to the outer wall of the stopper portion.

3. A tamper-proof stopper for plugging an opening in a container having a flange attached to its outer wall, the stopper comprising:

(a) plug means having a holding segment for securely holding and sealing the stopper in the opening of the container, said holding segment extending into the container and having an outside diameter corresponding to a diameter of an inner wall of the container to seal the stopper in the opening;

(b) a cover member attached to said plug means and having an annular section extending beyond the opening of the container to engage the flange to assist in holding the stopper in place in the container;

(c) a tamper-proof ring releasably attached to the annular section of said cover member, said tamper-proof ring having tabs means connected to an inner surface of said tamper-proof ring, said tab means being formed from a resilient material and being directed obliquely inward away from said inner surface of said ring in the direction of the opening of the container but not engaging said flange, so that said tab means engage said flange to hold the tamper-proof ring on the container when said cover member is removed for the first time; and (d) attachment means for releasably attaching said tamper-proof ring to said cover member, said attachment means being broken when said cover member is removed from the container for the first time thereby separating the cover member from the tamper-proof ring and providing a visual indication that the container has been opened.

4. The stopper according to claim 3, wherein the attachment means comprises a plurality of tear-off webs for securing the tamper-proof ring to the annular extension of said cover member.

5. The stopper according to claim 4, wherein the cover member comprises: a chamber, said chamber having a drying agent therein; and a resiliently fitted ring for holding down contents in the container.

6. The stopper according to claim 3, wherein said tab means comprises a plurality of tabs, each tab having a defined segment width; and said cover plug defines a plurality of recesses in said cover portion, each of said tabs corresponding to each of said recesses in number and in said tab segment width.

7. The stopper according to claim 6 wherein said tab segment width is about 20 angular degrees.

8. A tamper-proof device comprising:

(a) a container defining an opening and having an inner wall, an outer wall, and flange attached to the outer wall near the opening of the container;

(b) a stopper including a plug means having a holding segment for securely holding and sealing the stopper in the opening of the container, said holding segment extending into the container and having an outside diameter corresponding to a diameter of the inner wall of the container to seal the stopper in the container;

(c) a cover member attached to said plug means and having an annular section extending beyond the container opening to engage the flange of the container to assist in holding the stopper in place in said opening;

(d) a tamper-proof ring releasably attached to the annular section of said cover member, said tamper-proof ring having tabs means connected to an inner surface of said tamper-proof ring, said tab means being formed from a resilient material and being directed obliquely inward away from said inner surface of said ring in the direction of the opening of the container but not engaging said flange, so that said tab means engage said flange to hold the tamper-proof ring on the container when said cover member is removed for the first time; and (e) attachment means for releasably attaching said tamper-proof ring to said cover member, said attachment means being broken when said cover member is removed from the container for the first time thereby separating the cover member form the tamper-proof ring and providing a visual indication that the container has been opened.

* * * * *